US007993244B2

(12) United States Patent
Weller

(10) Patent No.: US 7,993,244 B2
(45) Date of Patent: Aug. 9, 2011

(54) CUSHIONING DEVICE AND SPRING FLOOR SYSTEM INCORPORATING SAME

(76) Inventor: Scott M. Weller, Cave Creek, AZ (US)

( * ) Notice: Subject to any disclaimer, the term of this patent is extended or adjusted under 35 U.S.C. 154(b) by 266 days.

(21) Appl. No.: 12/134,647

(22) Filed: Jun. 6, 2008

(65) Prior Publication Data

US 2009/0305849 A1 Dec. 10, 2009

(51) Int. Cl.
*A63B 21/00* (2006.01)

(52) U.S. Cl. ..... 482/26; 482/23; 482/30; 482/31

(58) Field of Classification Search ..... 482/23–35; 5/256, 248; 473/490; 52/403.1, 248; 267/180, 267/166.1
See application file for complete search history.

(56) References Cited

U.S. PATENT DOCUMENTS

| | | | | | |
|---|---|---|---|---|---|
| 71,169 | A | * | 11/1867 | Hayward | 5/256 |
| 176,174 | A | * | 4/1876 | French | 267/286 |
| 214,328 | A | * | 4/1879 | Vose | 267/4 |
| 274,715 | A | * | 3/1883 | Buckley | 267/180 |
| 1,450,686 | A | * | 4/1923 | Klaasse | 5/256 |
| 2,992,443 | A | * | 7/1961 | Winikoff | 5/248 |
| 4,120,489 | A | * | 10/1978 | Borlinghaus | 267/166.1 |
| 4,426,076 | A | * | 1/1984 | Palmer | 482/26 |
| 5,277,010 | A | * | 1/1994 | Stephenson et al. | 52/403.1 |
| 5,647,183 | A | | 7/1997 | Counihan | |
| 6,044,606 | A | | 4/2000 | Hamar | |
| 6,070,381 | A | * | 6/2000 | Blumer | 52/403.1 |
| 6,158,185 | A | | 12/2000 | Counihan | |
| 6,230,460 | B1 | * | 5/2001 | Huyett | 52/403.1 |
| 6,488,600 | B1 | * | 12/2002 | Gordon | 473/490 |
| 6,598,365 | B2 | | 7/2003 | Abraham et al. | |
| 6,931,808 | B2 | | 8/2005 | Hamar | |

OTHER PUBLICATIONS

Spring Floors 101—The Basics of the Spring Floor, downloaded Jan. 7, 2008, 4 pages, www.theamericangym.com/Floorinfo.htm.
McNeal, Jeni R., et al., Muscle Activation Characteristics of Tumbling Take-offs, Sports Biomechanics, vol. 6(3), Sep. 1, 2007, pp. 375-390, http://dx.doi.org/10.1080/14763140701491393.
Coventry, et al., Hitting the Vault Board; Implications for Vaulting Take-off—a Preliminary Investigation, Sports Biomechanics, vol. 5(1), Jan. 2006, pp. 63-76, Sports Biomechanics and Engineering, US Olympic Committee, Colorado Springs, CO USA.

* cited by examiner

*Primary Examiner* — Jerome W Donnelly
(74) *Attorney, Agent, or Firm* — Parsons & Goltry; Robert A. Parsons; Michael W. Goltry

(57) ABSTRACT

A floor system (20) includes a plurality of cushioning devices (22) attached to a lower side (40) of a wood floor (32). Each cushioning device (22) includes a spring (46) that may be attached at each of its ends to first and second caps (48, 50). The spring (46) includes longitudinally aligned regions (58, 60) interposed between the caps (48, 50). The region (58) exhibits a lower spring rate (64) than a spring rate (66) of the other region 60. In response to an imposed force, the first region (58) of spring (46) first compresses. When the imposed force is great enough, due to a user's weight, the second region (60) of spring (46) will then compress.

7 Claims, 2 Drawing Sheets

CUSHIONING DEVICE AND SPRING FLOOR SYSTEM INCORPORATING SAME

TECHNICAL FIELD OF THE INVENTION

The present invention relates to the field of cushioning devices for flat surfaces. More specifically, the present invention relates to a coiled spring device that creates a cushioning effect in a spring floor system.

BACKGROUND OF THE INVENTION

There are a number of sport surfaces, or floor systems, that have been developed to provide safety and protection for athletes, dancers, and the like engaged in active sport applications. These sport surfaces function to absorb shock, reduce fatigue, limit injury, and enhance performance. Some sport surfaces are supported by foam backing or rubber feet, others are cushioned mechanically through the inclusion of springs, and still others use a combination of springs and foam cubes.

In gymnastics, the "floor" or "spring floor" refers to a specially prepared sport surface, which is considered an apparatus. It is used by both male and female gymnasts. The event in gymnastics performed on such a spring floor is known as floor exercise. A typical spring floor contains springs and/or foam rubber cubes. A plywood floor overlies the springs and/or foam rubber cubes. The plywood floor may then be covered with additional foam and a top layer of carpet. The intent of this spring floor structure is to make the floor bouncy, soften the impact of landings, and enable the gymnast to gain height when tumbling.

On other gymnastics apparatuses athletes can rely on their own strength to lift, support, or swing their bodies. However, in floor exercise, a great deal of the athlete's performance is due, not only to their own strength and control, but additionally to the rebounding effect of the spring floor. Gymnasts can range in age from eight or nine to almost thirty years of age. An eight year old gymnast may weigh as little as sixty pounds, whereas, a fully mature athlete may weigh one hundred forty pounds or more.

Unfortunately, existing spring floor systems fail to provide adjustability for the differing sizes, and more specifically, the differing weights of gymnasts. That is, lighter weight gymnasts jump and land on the same spring floor system as heavier weight gymnasts. The heavier weight gymnasts will get more "spring" or rebound from the spring floor because they are able to more effectively compress the floor materials, particularly the springs or cubes in the spring floor. Thus, the spring floor feels bouncy to a heavier gymnast. In contrast, the spring floor will feel relatively hard to a lighter weight gymnast whose weight will only just barely compress the springs or cubes.

This discrepancy can result in competitive disadvantages, even within the same age groups or competition levels since athletes come in different weights. Prior art spring floors suffer from other problems as well. For example, some prior art spring floors make a cupping motion under the athlete when the athlete lands. The pressure caused by this cupping results in the most force on the medial aspect of the foot. The intensity of this force on the feet, legs, and knees combined with the repetitions involved in training and competition can cause many types of injuries. Furthermore, since the spring floor barely compresses for a lighter weight gymnast, he or she may be at even greater risk of injury.

A floor exercise routine can include three, four, or five major tumbling passes and several major dance skills, turns and leaps. In each tumbling sequence, the gymnast links several acrobatic skills in a series, which generally culminates with an acrobatic flight skill. To achieve the acrobatic skills, the gymnast must change the horizontal velocity created by the preceding linked tumbling skills into vertical velocity. This explosive movement immediately precedes the somersault and is called a "take-off."

During a tumbling take-off, a gymnast may impact the floor surface from either a forward- or backward-facing body orientation, and may rebound into an aerial somersault that rotates either forward or backward. It has been observed through recordation using high speed video, that gymnasts typically bend their knees twice during the execution of a backward tumbling take-off, referred to herein as a "double knee bend." The first knee bend is initiated by the gymnast when executing the backward tumbling take-off. However, it is believed that the second knee bend is not intended by the gymnast. Rather, it is hypothesized that the second knee bend may be due to the recoil of the spring floor and the nature of the floor's fundamental frequency. The fundamental frequency of the spring floor is approximately twice that of the gymnast. Therefore, the floor does not move in synchrony with the gymnast's take off actions. Rather, the "rhythm" of the floor's movements are about twice as fast as the gymnast's down-and-up movements during a tumbling takeoff.

When performing a backward tumbling take-off the gymnast typically experiences dorsiflexion, a movement which decreases the angle between the foot and the leg. That is, the toes move toward the shin. If this dorsiflexion is combined with an upward thrust, i.e., recoil movement, of the floor and/or an extension of the knee, a ruptured Achilles tendon and/or anterior talotibial impingement (bumping the talus into the mortice formed by the tibia and fibula) may occur. A rupture of the Achilles tendon can be a debilitating injury that may require surgical repair, and thus limit or end the career of an elite gymnast.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

An embodiment entails a device for cushioning a sport surface. The device includes a spring that exhibits at least two spring rates in order to provide compressibility over a greater range of forces imposed by athletes and dancers of various sizes, and more specifically, various weights. Another embodiment entails a spring floor system that includes a plurality of the cushioning devices. The compressibility of the cushioning devices in a spring floor system can reduce the intensity and incidence of the double knee bend phenomenon during tumbling take-offs thus resulting in a lowered potential for injury.

Figure 1:
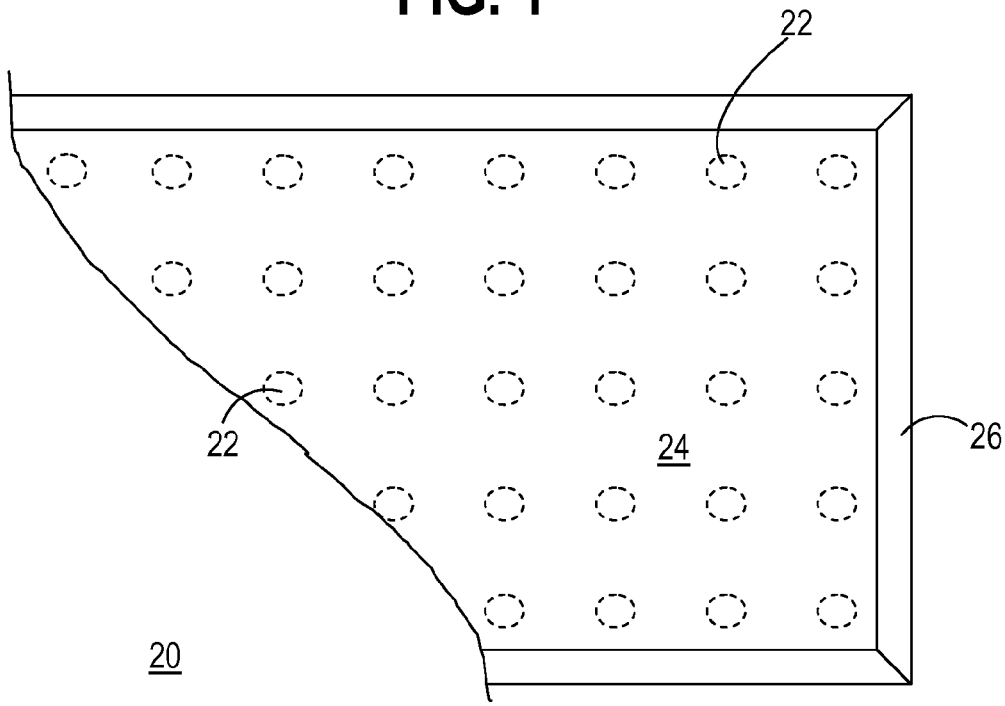
FIG. 1 shows a partial top view of a spring floor system in accordance with an embodiment of the invention.

FIG. 1 shows a partial top view of a spring floor system 20 in accordance with an embodiment of the invention. Spring floor system 20 includes a plurality of cushioning devices 22

(shown in ghost form) underlying a top side 24 of floor system 20. A conventional border 26 surrounds top side 24. Spring floor system 20 may be an apparatus for floor exercise in gymnastics. However, floor system 20 may also be used for other athletic and dance activities, for both training and competitive purposes. In addition, cushioning devices 22 may be incorporated into various flat surfaces for providing a cushioning and rebounding effect, such as in vault boards, springboards, portable floors, walls, crash mats, and the like.

Figure 2:
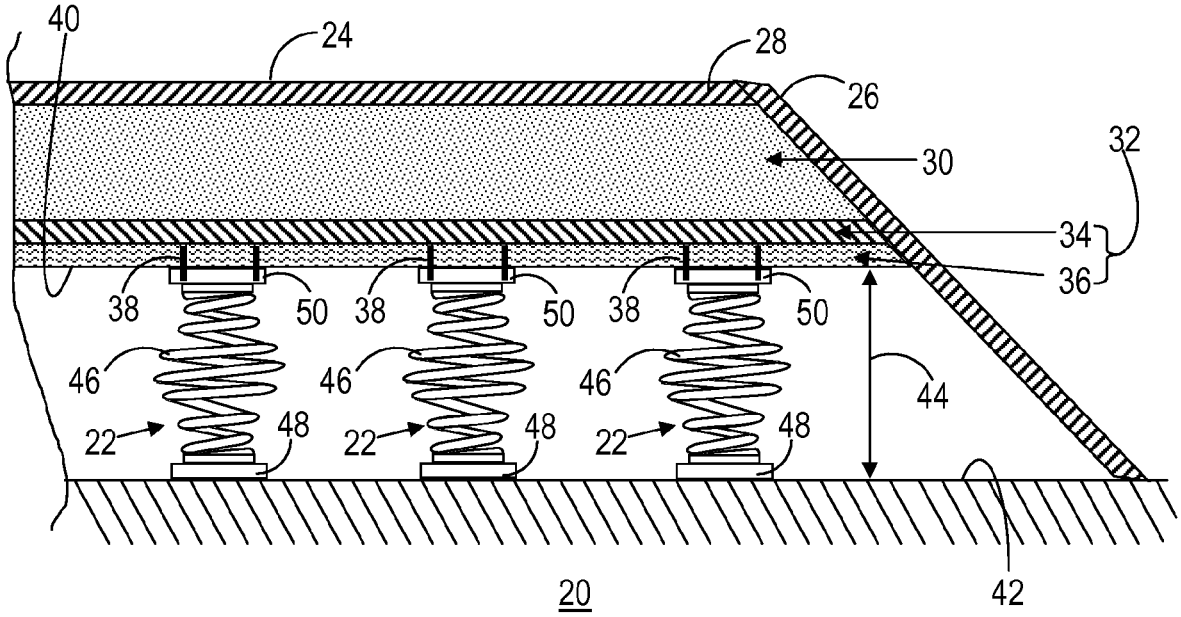
FIG. 2 shows a partial side view of the spring floor system of FIG. 1.

FIG. 2 shows a partial side view of spring floor system 20. In general, spring floor system 20 includes a top layer of carpet 28 that forms top side 24. Foam 30 underlies carpet 28. Typically, the combination of carpet 28 and foam 30 is designed to be approximately one and three eighths to two inches thick.

A wood floor 32 underlies foam 30. In typical arrangements, wood floor 32 includes a first plywood layer 34 and a second plywood layer 36, each of which is usually three eighths to one half inch thick. Typically, first and second plywood layers 34 and 36 are manufactured from pine plywood oriented strand board (OSB) or Baltic birch to achieve sufficient strength and satisfactory longevity.

Cushioning devices 22 underlie wood floor 32. Cushioning devices 22 are spaced apart from one another. For example, cushioning devices 22 may be spaced such that there is one cushioning device 22 per square foot. Each of cushioning devices 22 includes one or more fasteners 38 configured for attaching cushioning devices 22 to a lower side 40 of wood floor 32.

Cushioning devices 22 may rest upon a base surface 42, such as a gymnasium floor, a concrete surface, or another plywood layer. Cushioning devices 22 position wood floor 32 above base surface 42 by a predetermined height 44, for example, at a height that is greater than four inches.

Each of cushioning devices 22 includes a spring 46, a first cap 48, and a second cap 50, the details of which will be discussed below. In one embodiment, fasteners 38 extend through second cap 50 to couple each of cushioning devices 22 to lower side 40 of wood floor 32.

Figure 3:
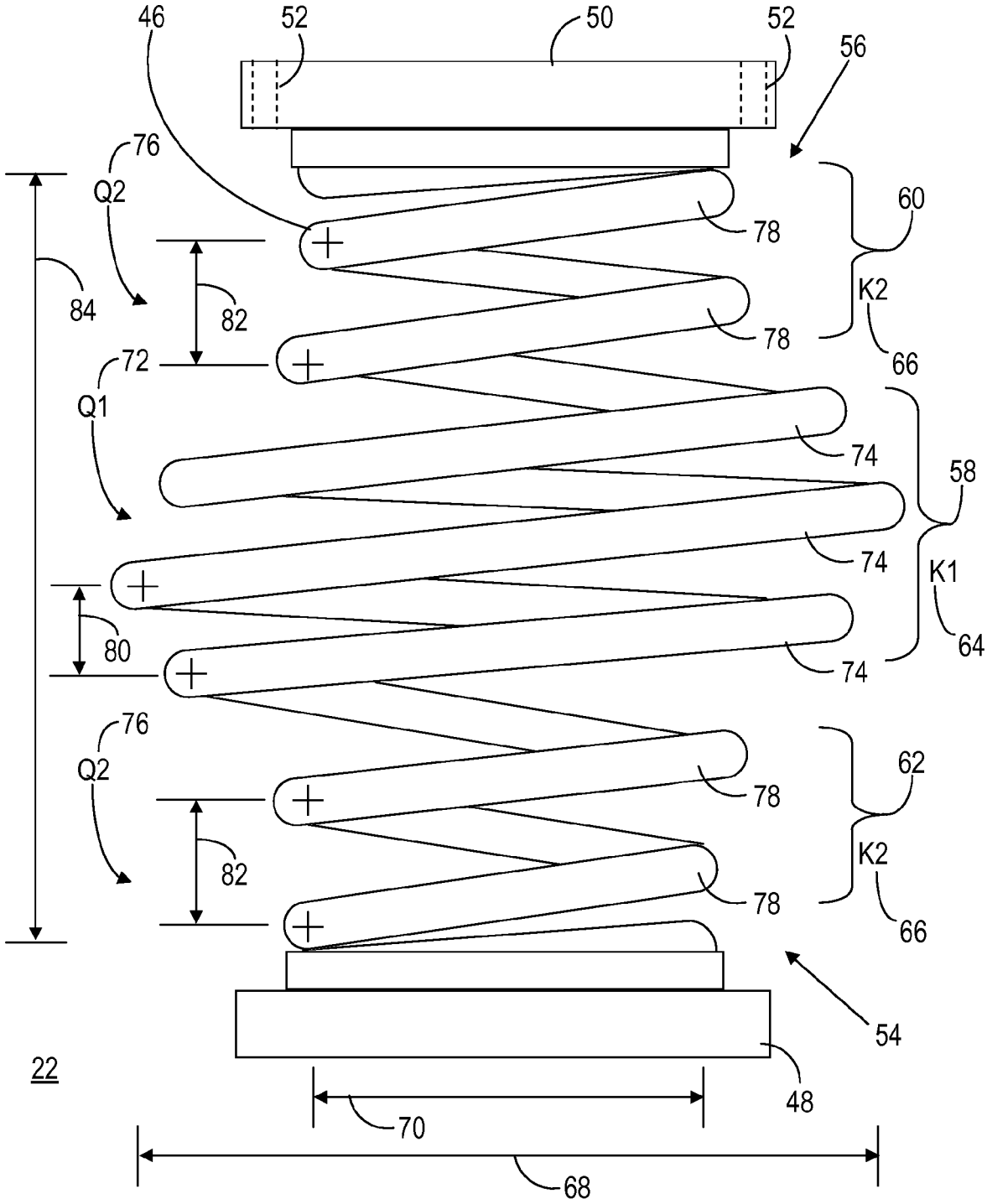
FIG. 3 shows a side view of a cushioning device in accordance with another embodiment of the invention.

FIG. 3 shows a side view of one of cushioning devices 22. Although only one of cushioning devices 22 is shown and described in detail, it should be understood that the following description applies equivalently to each of cushioning devices 22 used in spring floor system 20 (FIG. 1).

As mentioned above, cushioning device 22 includes spring 46, first cap 48, and second cap 50. Second cap 50 is illustrated with openings 52, shown in ghost form. In one embodiment, fasteners 38 (FIG. 2) may be inserted through openings 52 of second cap 50 so that cushioning device 22 can be attached to lower side 40 (FIG. 2) of wood floor 32 (FIG. 2).

Spring 46 is compression spring in the form of a coil spring wound in a helix. Spring 46 has a first end 54 affixed to first cap 48 and a second end 56 affixed to second cap 50. Spring 46 includes at least two longitudinally aligned regions. For example, in one embodiment, spring 46 includes a first region 58, a second region 60, and a third region 62. Second region 60 includes second end 56 affixed to second cap 50. Whereas, third region 62 includes first end 54 affixed to first cap 48. Thus, first region 58 is interposed between second and third regions 60 and 62, respectively.

Spring 46 generally exhibits at least two spring rates, sometimes referred to as a variable spring rate. "Spring rate" (also known as a "spring constant," "spring scale," or "spring gradient") is the amount of weight needed to compress a spring a distance. The spring rate of a spring is typically rated in lb/in, which refers to the pounds of weight required to depress the spring by one inch, or kg/mm, which refers to the kilograms of weight required to depress the spring by one millimeter. A spring that has a low spring rate is soft, whereas, a spring that has a high spring rate is stiff. Thus, a spring having a low spring rate will deflect a greater distance under a given load than a spring having a higher spring rate under the same load.

In the embodiment shown, first region 58 exhibits a first spring rate, K1, 64. Second and third regions 60 and 62, respectively, exhibit a second spring rate, K2, 66 that is greater than first spring rate 64. In a coil spring, such as spring 46, the spring rate can be affected by a number of factors. These factors include diameter of the wire used to form the coil spring, mean diameter of the spring, the number of active coils, and the spacing (i.e., pitch) between adjacent coils.

The diameter of the wire itself affects the spring rate because as the diameter of the wire increases it gets stronger, thus the spring is harder to compress. That is, as wire diameter increases, the spring rate increases. The mean diameter of the spring is the diameter of the wire subtracted from the overall outside diameter of the coil spring. Thus, as the mean diameter of the spring increases, the spring rate decreases. The active coils of a spring are those coils that deform when the spring is loaded, as opposed to the inactive coils at each end which are in contact with the spring seat or base, but do not substantially deform. In general, as the number of active coils decrease, the spring rate increases. Coil spacing, or pitch, refers to the distance from center to center of the wire in adjacent active coils. Generally, as the coil spacing decreases, the spring rate also decreases.

In the embodiment shown, the factors of mean diameter of the spring, the number of active coils, and the spacing (i.e., pitch) between the coils are utilized to produce first spring rate 64 in first region 58 and second spring rate 66 in each of second and third regions 60 and 62. For example, first region 58 has a first mean diameter 68. Whereas, second and third regions 60 and 62, respectively, have a second mean diameter 70 that is less than first mean diameter 68. Thus, spring 46 has a generally bell-shaped or tapered configuration formed by the variance between first and second mean diameters 68 and 70. In addition, first region 58 has a first quantity, Q1, 72 of first coils 74 (in this example, three of first coils 74). Each of second and third regions 60 and 62 has a second quantity, Q2, 76 of second coils 78 (in this example, two of second coils 78) that is less than first quantity 72. Furthermore, a first coil spacing 80 between adjacent first coils 74 is less than a second coil spacing 82 between adjacent second coils 78.

The affect of varying mean diameter of the spring, the number of active coils, and the spacing (i.e., pitch) between first coils 74 of first region 58 relative to second coils 78 of each of second and third regions 60 and 62 results in spring 46 being softer in first region 58 than in either of second and third regions 60 and 62. As such, when spring 46 is subject to a force, first coils 74 will first compress. If more force continues to be applied, second coils 78 in second and third regions 60 and 62 will then activate.

In its application in cushioning device 22 for spring floor system 20 (FIG. 1), the lower first spring rate 64 of first region 58 is selected so that a lower weight, e.g., sixty pound, athlete can compress first region 58 in the normal course of tumbling. However, the lower weight athlete is unlikely to compress second and third regions 60 and 62, respectively. The higher second spring rate 66 of second and third regions 60 and 62 is selected to be stiff enough so that a heavier, e.g. two hundred pound, athlete compresses both first region 58 and then second and third regions 60 and 62. In addition, an athlete in a middle weight range will compress first region 58 and perhaps only slightly compress second and third regions 60 and 62. Consequently, use of cushioning devices 22 creates a cushioning effect for athletes of a variety of sizes and weights. In addition, it is believed that this cushioning effect can reduce the intensity and incidence of the "double knee bend" phenomenon observed during backward tumbling take-offs.

Spring 46 exhibits a free length 84. The term "free length" refers to the maximum length of a compression spring when it is lying freely prior to assembly into its operating position and hence prior to loading. Free length 84 of spring 46 may be approximately four inches so that existing floor systems can be readily updated or retrofit with cushioning devices 22. This four inch length of spring 46 is the typical standard length for prior art spring and foam systems. Thus, a retrofit with cushioning devices 22 would not call for new borders 26 (FIG. 1) or modifications to the carpet size.

In addition, second mean diameter 70 of each of second and third regions 60 and 62 may be substantially equal to the mean diameter of existing springs in prior art floor systems. Thus, existing floor systems may be readily updated or retrofit merely by replacing the existing springs seated in the conventionally used caps with spring 46. Consequently, although cushioning device 22 is described therein as including spring 46, first cap 48, and second cap 50, in an alternative embodiment, cushioning device 22 may merely include spring 46 exhibiting at least two spring rates.

It should be understood that the stiffness/softness of first, second, and third regions 58, 60, and 62 can be customized for a particular environment and/or a particular athletic or dance activity. As such, in alternative embodiments, spring 46 need not exhibit the tapered, bell shape shown herein, but may take on various other shapes, such as a tubular shape of constant mean diameter with varying coil spacing and varying quantities of coils.

Furthermore, spring 46 need not include three regions, but may alternatively have two regions exhibiting different spring rates, more than three regions exhibiting different spring rates, and so forth. In a two region configuration, spring 46 may include first region 58 and second region 60, but not third region 62. In such a configuration, second end 56 of second region 60 will affixed to a conventional cap, such as second cap 50. However, first cap 48 may be larger in order to accommodate first mean diameter 68 of first region 58.

In addition, since wire diameter also affects the stiffness of a spring, in another alternative embodiment, various discrete regions of a variable rate coil spring may be formed from wires of differing diameters. These various regions can then be attached end to end by, for example, welding, brazing, crimping, and so forth. Of course, these discrete regions may additionally have differing mean diameters, differing quantities of coils, and/or differing coil spacing.

In summary, the present invention teaches of a cushioning device for cushioning a sport surface, such as a spring floor system. The variable rate spring configuration of the cushioning device provides compressibility over a greater range of forces imposed by athletes and dancers of various sizes, and more specifically, various weights. Thus, the sport surface is more equitable to different weight athletes by allowing a much greater range of forces that can compress and rebound the surface. More critically, the compressibility of the cushioning devices over a variety of weights in the sports surface results in a lowered potential for injury. In addition, the variable weight spring configuration of the cushioning device can reduce the incidence and intensity of the "double knee bend" phenomenon observed during a backward tumbling take-off when the spring devices are incorporated into a spring floor system. Such a reduction can reduce the potential for debilitating injuries such as a ruptured Achilles tendon and/or anterior talotibial impingement (bumping the talus into the mortice formed by the tibia and fibula). Furthermore, the size and configuration of cushioning devices enables them to be readily incorporated into existing spring floor systems.

Although the preferred embodiments of the invention have been illustrated and described in detail, it will be readily apparent to those skilled in the art that various modifications may be made therein without departing from the spirit of the invention or from the scope of the appended claims.

What is claimed is:

1. A spring floor system comprising:

a wood floor having a lower side; and a plurality of cushioning devices attached to said lower side of said wood floor, each of said devices including:

a spring having a first end and a second end, said spring including a first region and a second region longitudinally aligned with said first region, said first and second regions being interposed between said first and second ends, said first region exhibiting a first spring rate, and said second region exhibiting a second spring rate that is greater than said first spring rate;

wherein said spring is wound in a helix such that said first region has a first mean diameter and said second region has a second mean diameter, said second mean diameter being less than said first mean diameter;

wherein said spring is wound in a helix such that first coils of said first region have a first spacing between said first coils, and second coils of said second region have a second spacing between said second coils, said second spacing being greater than said first spacing;

a first cap, said first end being affixed to said first cap; and a second cap, said second end being affixed to said second cap wherein said floor has at least a partially open underside, allowing said first cap to contact a base surface.

2. A spring floor system as claimed in claim 1 wherein said plurality of cushioning devices are spaced apart from each other.

3. A spring floor system as claimed in claim 1 wherein said spring floor system is configured to rest upon said base surface, and said plurality of cushioning devices position said wood floor above said base surface a predetermined height.

4. A spring floor system as claimed in claim 1 wherein said spring further includes a third region exhibiting said second spring rate, and said first region of said spring is interposed between said second and third regions.

5. A spring floor system as claimed in claim 3 wherein:

said first cap is configured to rest upon said base surface;

said third region of said spring includes said first end affixed to said first cap;

said second region of said spring includes said second end affixed to said second cap; and said each of said devices further includes a fastener extending through said second cap to couple said each device to said lower side of said wood floor.

6. A device for cushioning a sport surface comprising:

a spring having a first end and a second end, said spring including longitudinally aligned first, second, and third regions interposed between first and second ends, said first region exhibiting a first spring rate, and each of said second and third regions exhibiting a second spring rate that is greater than said first spring rate;

wherein said spring is wound in a helix such that said first region has a first mean diameter and said each of said second and third regions has a second mean diameter, said second mean diameter being less than said first mean diameter;

wherein said spring is wound in a helix such that first coils of said first region have a first spacing between said first coils, and second coils of each of said second and third regions have a second spacing between said second coils, said second spacing being greater than said first spacing;

a first cap, said first end of said first spring being affixed to said first cap; and a second cap, said second end of said first spring being affixed to said second cap.

7. A device as claimed in claim 6 wherein said spring is wound in a helix such that said first region includes a first quantity of coils and said second and third regions include a second quantity of coils, said first quantity of coils being less than said first quantity of coils.

* * * * *